US008142539B2

(12) United States Patent
Kokkonen et al.

(10) Patent No.: US 8,142,539 B2
(45) Date of Patent: Mar. 27, 2012

(54) METHOD AND ARRANGEMENT FOR FEEDING AN ANODE INTO A SMELTING REACTOR

(75) Inventors: Kasper Kokkonen, Vantaa (FI); Jarmo Koskimaa, Espoo (FI); Satu Jyrkönen, Vanha-Ulvila (FI)

(73) Assignee: Outokumpu Oyj, Espoo (FI)

( * ) Notice: Subject to any disclaimer, the term of this patent is extended or adjusted under 35 U.S.C. 154(b) by 1465 days.

(21) Appl. No.: 10/519,955

(22) PCT Filed: Jun. 12, 2003

(86) PCT No.: PCT/FI03/00465

§ 371 (c)(1),
(2), (4) Date: Dec. 30, 2004

(87) PCT Pub. No.: WO2004/005822

PCT Pub. Date: Jan. 15, 2004

(65) Prior Publication Data

US 2005/0223845 A1 Oct. 13, 2005

(30) Foreign Application Priority Data

Jul. 5, 2002 (FI) ..... 20021320

(51) Int. Cl.
*C21C 5/52* (2006.01)

(52) U.S. Cl. ..... 75/10.23; 373/69

(58) Field of Classification Search ..... 373/69; 75/10.23

See application file for complete search history.

(56) References Cited

U.S. PATENT DOCUMENTS 4,578,977 A * 4/1986 Murakami et al. ..... 72/135
5,685,892 A 11/1997 Ikoma et al. ..... 75/652
6,574,263 B1 6/2003 Iida et al. ..... 373/71

* cited by examiner

*Primary Examiner* — Jie Yang
(74) *Attorney, Agent, or Firm* — Locke Lord LLP

(57) ABSTRACT

The invention relates to an arrangement for feeding an anode into a metallurgical smelting reactor (2), such as a flash converter, said arrangement including a feeding funnel (7) made of at least one part for feeding at least one anode (4) at a time into the smelting reactor, said arrangement also including a bending element (5) for bending the anode, so that the essentially completely bent anode (4) is arranged to meet the surface of the melt (8) contained in the smelting reactor in an essentially horizontal position. The invention also relates to a method for feeding an anode into a metallurgical smelting reactor (2).

11 Claims, 1 Drawing Sheet

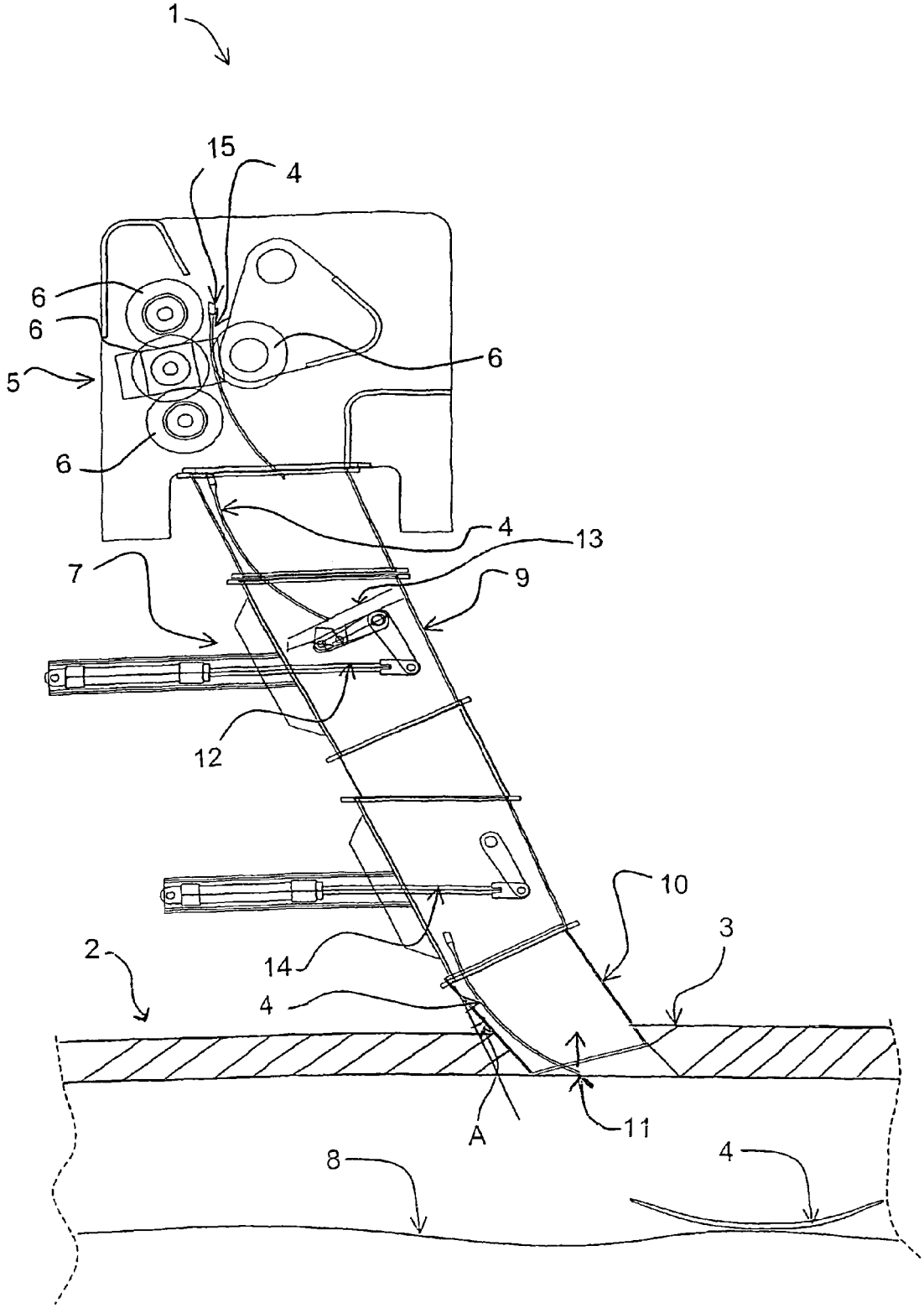
1
15
4
6
6
5
6
6
4
13
7
9
12
10
3
2
14
4
A
11
8
4

METHOD AND ARRANGEMENT FOR FEEDING AN ANODE INTO A SMELTING REACTOR

The invention relates to an arrangement and method defined in the preamble of the independent claims for feeding an anode into a metallurgical smelting reactor.

In the flash smelting of copper, the dried copper concentrate is fed into a furnace together with oxygen-enriched air and silica sand. The energy needed in the smelting process is created in the oxidation of sulfur and iron. Molten phases are separated from the gas in the settler as slag and matte are settled on the furnace bottom, so that the matte layer is placed lowest underneath. The primary task of slag is to gather in a fluent, dischargeable form the iron oxides created in the smelting process, as well as the silicatic and oxidic ingredients of the gangue. The matte obtained from a smelting furnace is further processed by converting. In converting, oxygen is blasted in the melt, and there is created blister copper, i.e. raw copper, with a copper content of the order 99 per cent. The copper remaining in the slag is recovered by flotation, and by feeding the high-copper slag concentrate back into the smelting furnace or by treating the slag in oxidizing conditions, for example in an electric furnace. After converting, blister copper still contains a certain amount of sulfur, wherefore it is further refined in an anode furnace. The purpose of the refining process is to decrease the sulfur content so low that copper anodes can be cast. After refining, copper is cast into copper anodes to be used in electrolysis, where copper cathodes are manufactured.

In electrolysis, copper anodes are dissolved along with the process, and copper is precipitated on the cathode surfaces. However, the whole anode cannot be utilized in electrolysis, but undissolved remnants, i.e. anode scrap, is left of the anodes. Generally anode scrap is fed back into the smelting reactor, in order to resmelt it and thus to utilize the copper contained therein.

However, as anode scrap contains a large amount of copper after the anode furnace treatment, it is not sensible, from an energy-economical point of view, to feed the anode scrap back into a flash smelting furnace or other corresponding first oxidizing metallurgic reactor of copper concentrate. It is known that anode scrap is fed into a converter in order to advantageously recover the copper contained therein. However, when feeding sharp, sheet-like anodes into a converter, they have been noticed to cause damage to the reactor linings when anodes are dropped into the melt.

From the U.S. Pat. No. 5,685,892, there is known an arrangement and method for feeding anode scrap into a metallurgical furnace used in copper smelting. According to said publication, anode scrap is fed into the furnace through a charging assembly, said assembly being provided with a device that prevents the anode from damaging the furnace bottom when it is dropped into the melt. As means for protecting the furnace bottom when anode scrap is fed in, the patent describes the bending of the anode ends and a turning mechanism that alters the dropping trajectory by means of a jump rail construction. The end of an anode is bent, and the anode is dropped into a dropping chute provided in connection with the charging assembly, so that the bent part of the anode is the lower end, when seen in the dropping direction, and the bent end points towards the ceiling of the charging chute. As the anode meets the melt surface, the area of the bent part slows down the immersion of the anode.

In the U.S. Pat. No. 5,497,978, there is described an apparatus for charging anode scrap into a converter. The patent depicts how anode scrap is fed by means of a charging mechanism, along a chute, into a converter. In addition, it is described how, by using adjustable shutters provided in connection with the chute, the space located inside the furnace is insulated from the air outside the furnace.

Among the drawbacks of the prior art solutions, there are the complexity of the arrangements and the steep dropping trajectory of the anodes into the melt.

The object of the present invention is to introduce a novel solution for feeding anode scrap into a smelting reactor. A particular object of the invention is to feed an anode into a smelting reactor as essentially completely bent and so that during the falling of the anode, its trajectory is altered, so that it meets the melt surface in an essentially horizontal position.

The invention is characterized by what is set forth in the preamble of the independent claims. Other preferred embodiments of the invention are characterized by what is set forth in the rest of the claims.

Many advantages are gained by the method and arrangement according to the invention for feeding an anode into a metallurgical smelting reactor, and drawbacks of the prior art are avoided by means of the invention. According to the invention, an arrangement for feeding an anode into a metallurgical smelting reactor, such as a flash converter, includes a feeding funnel made of at least one piece, for feeding at least one anode at a time into a smelting reactor, and the arrangement also includes a bending element for bending the anode, so that the essentially completely bent anode is arranged to meet the surface of the melt contained in the smelting reactor in an essentially horizontal position. By using the arrangement according to the invention, it is possible to feed anodes into the smelting reactor either in a batch or one by one. By bending the anode essentially completely, i.e. on both sides with respect to its center, it is possible to shift its center of gravity and thus to achieve an advantageous effect in its dropping behavior. According to a preferred embodiment, the feeding funnel is arranged in the immediate vicinity of the reaction shaft of the smelting reactor. By dropping the anodes in the vicinity of the reaction shaft, they are obtained in an optimal area with respect to the smelting process.

According to a preferred embodiment of the invention, the feeding funnel is made of two parts, a top part and a bottom part, so that the angle of inclination of the top part with respect to the horizontal level is larger than the angle of inclination of the bottom part. The placing of the bottom part at a different angle than the top part, the anode trajectory—as the anode is dropped—is altered advantageously so that the anode is made to turn into a horizontal position. According to a preferred embodiment, the angle between the top part and the bottom part of the feeding funnel is essentially 10-30 degrees. According to another preferred embodiment, the feeding funnel includes a trajectory-shifting element for altering the trajectory of the anode. The employed trajectory-shifting element can be for instance a jump rail or a corresponding bracket provided on the surface of the feeding funnel. According to a preferred embodiment, the distance between the feeding funnel bottom part and the surface of the melt contained in the reactor is advantageously 0.8-1.3 meters, so that the anodes are dropped into the melt in an optimal fashion. According to a preferred embodiment, the anode bending element for bending the anode consists of four rolling rollers located above the feeding funnel. Advantageously the bending element provided in connection with the feeding funnel can be placed so that the anodes are bent immediately before dropping them into the smelting reactor. The diameter of the roller is 100-500 millimeters, advantageously 300 millimeters. The radius of curvature of an anode bent in the bending element is 1,000-3,000 millimeters, advantageously 1,500 millimeters. Now there is achieved a shape that is advantageous for the dropping of the anode, and the curved anode surface that meets the melt slows down the immersion of the anode, and hence the anode does not cause damage in the furnace bottom. According to a preferred embodiment of the invention, the anodes are arranged to drop into the smelting reactor one by one. According to another preferred embodiment, the anodes are arranged to drop into the reactor in batches of several anodes. According to a preferred embodiment, the anodes are dropped into the furnace so that the anode grip brackets, i.e. lugs, are pointed upwards. According to a preferred embodiment, in connection with the feeding funnel, there are provided at least two shutter elements in order to prevent the furnace atmosphere from leaking to the surroundings. According to a preferred embodiment, the feeding funnel includes elements that guide the sliding direction of the anode. Said guiding prevents a harmful rotating motion of the anode.

According to the method according to the invention for feeding an anode into a metallurgical smelting reactor, such as a flash converter, at least one anode is fed at a time through a feeding funnel made of at least one part to a smelting reactor, and said anode is also bent by means of a bending element, so that the anode is bent essentially completely and it meets the surface of the melt contained in the smelting reactor in an essentially horizontal position. According to a preferred embodiment of the method, the bending element is made of four rolling rollers with a diameter of 100-500 millimeters. According to a preferred embodiment, the anode is in the bending element bent so that the obtained radius of curvature for the anode is essentially 1,000-3,000 millimeters. According to a preferred embodiment, anodes are dropped into the smelting reactor one by one. According to a preferred embodiment, anodes are dropped into the smelting reactor in batches of several anodes. According to a preferred embodiment of the method, an anode drops into the furnace so that the anode grip brackets, i.e. lugs, are pointed upwards. By using the arrangement and method according to the invention, anodes are fed into a smelting reactor in a simple and rapid fashion which does not disturb the converting process proper.

The invention is described in more detail below with reference to the appended drawings.

FIG. 1 Arrangement according to the invention

FIG. 1 illustrates an arrangement 1 and method according to the invention for feeding anode scrap into a metallurgical smelting reactor 2. The arrangement according to the invention is placed in the vicinity of the reaction shaft of a smelting reactor, such as a flash converter, above the furnace arc structure 3. In the vicinity of the reaction shaft, there prevails a high temperature, which enhances a rapid smelting of the anodes.

The undissolved anodes 4 left from the electrolysis are bent prior to feeding them into the smelting reactor 2. The anodes are either bent immediately after electrolysis in the electrolytic plant, or they are transported to be bent in connection with the smelting reactor. In an example according to FIG. 1, the bending element 5 for bending the anodes is placed in the immediate vicinity of a smelting reactor, such as a flash converter. Prior to dropping into the smelting reactor, the anodes are treated in a bending element 5. The bending element comprises a required number of rolling rollers 6, in the example depicted in the drawing four rollers, and the anodes are bent between said rollers. The anodes 4 are fed into the bending element for example along a separate feeding line, from which they are conducted to be bent either one by one or in batches of several anodes. The diameter of the rollers 6 is preferably 300 millimeters. The radius of curvature of the anodes created in the bending can be adjusted, and advantageously it is 1,500 millimeters. The rolling rollers are operated for instance hydraulically, in which case a hydraulic pressure roller included in the roller is opened under strain. When the thickest part of the anode, i.e. the lugs thereof, falls in between the rollers, the roller is opened owing to the strain directed to it and releases the ready-bent anode from pressure. In other words, the rollers only bend the section of the anode proper. A straight anode is drawn between the rollers in an essentially vertical direction, so that its grip brackets, i.e. lugs 15 point upwards, and the anode is bent essentially completely. Thus the center of gravity of the anode is advantageously shifted, which further affects the dropping behavior of said anode. Anodes are bent either in batches or one by one.

According to the example, the anodes bent in the bending element are dropped into a feeding funnel 7, through which the anodes fall under gravity to the melt 8 contained in the smelting reactor 2. Advantageously the feeding funnel is in an inclined position, and it consists of two parts, the top part 9 and the bottom part 10. The feeding funnel 7 is constructed so that the bottom part 10 thereof forms a smaller angle with the horizontal line, whereas the top part 9 forms a larger angle. Owing to the different inclination of the bottom part, a vertical force is directed to the anode as it meets the bottom part of the funnel, which affects the trajectory of the anode. Preferably the angle between the top part and the bottom part is 20 degrees. The angle deviation of the bottom part of the feeding funnel causes a change in the anode momentum, which turns the anode into a horizontal position. The vertical force turns that end 11 of the anode that points downwardly towards the furnace upwardly, in the direction of the arrow. Thus the anode or anode batch is dropped on the surface of the melt 8, preferably in a horizontal position. The bottom linings of the furnace are saved from any damage caused by the collision of the falling anode, because the anode is not dropped vertically and directly onto the bottom.

The feeding funnel includes two shutter elements, such as shutters 12 and 14, in order to prevent the atmosphere prevailing in the furnace from leaking into the surroundings. In connection with the upper shutter 12, there is arranged a reception element 13 for receiving the anode, when the anode is dropped into the feeding funnel 7. While the anode rests on the reception element, the upper shutter is opened, but the lower shutter 14 remains shut. When the anode has dropped past the upper shutter, the upper shutter is closed, whereafter the lower shutter 14 is opened, and the anode is free to fall past it. Now the anode falls onto the more inclined surface provided at the final end of the feeding funnel, where it is subjected to a vertical force, and its trajectory is altered. When necessary, the feeding funnel can be provided with elements guiding the sliding direction of the anode, said elements guiding the anodes downwardly in a desired fashion, in order to prevent the anode from rotating uncontrollably in the feeding funnel.

For a man skilled in the art, it is obvious that the various preferred embodiments of the invention are not restricted to the examples described above, but may vary within the scope of the appended claims.

The invention claimed is:

1. An apparatus for feeding an anode into a metallurgical smelting reactor in an essentially horizontal position, said apparatus comprising:

a bending element consisting of four rolling rollers configured to essentially completely bend the anode on both sides thereby providing the anode with a radius of curvature of about 1,000- about 3,000 millimeters, wherein each rolling roller has a diameter ranging from 100-500 millimeters;

a feeding funnel located below the bending element made of at least one part for feeding at least one anode at a time into the smelting reactor;

wherein the apparatus is configured such that the essentially completely bent anode meets the surface of a melt contained in the smelting reactor in an essentially horizontal position.

2. An apparatus according to claim 1, wherein the feeding funnel is arranged in the immediate vicinity of the reaction shaft of the smelting reactor.

3. An apparatus according to claim 1, wherein the feeding funnel is made of two parts: a top part and a bottom part, so that the angle of inclination of the top part with respect to the horizontal level is larger than that of the bottom part.

4. An apparatus according to claim 3, wherein an angle between the top part and the bottom part of the feeding funnel is about 10-30 degrees.

5. An apparatus according to claim 1 wherein the feeding funnel is provided with a trajectory-shifting element in order to alter the trajectory of the anode.

6. An apparatus according to claim 3, wherein the distance between the bottom part of the feeding funnel and the surface of the melt contained in the reactor is 0.8-1.3 meters.

7. An apparatus according to claim 1, wherein the anodes are arranged to drop into the smelting reactor one by one.

8. An apparatus according to claim 1, wherein the anodes are arranged to drop into the smelting reactor in batches of several anodes.

9. An apparatus according to claim 1, wherein the anode is arranged to drop into the smelting reactor so that the anode grip brackets are pointed upwards.

10. An apparatus according to claim 1, wherein in connection with the feeding funnel, there are provided at least two shutter elements for preventing the furnace atmosphere from leaking to the surroundings.

11. An apparatus according to claim 1, wherein the feeding funnel is provided with elements for guiding the sliding direction of the anode.

* * * * *